US009818512B2

(12) United States Patent
Martin et al.

(10) Patent No.: US 9,818,512 B2
(45) Date of Patent: Nov. 14, 2017

(54) THERMALLY SPRAYED THIN FILM RESISTOR AND METHOD OF MAKING

(71) Applicant: VISHAY DALE ELECTRONICS, LLC, Columbus, NE (US)

(72) Inventors: Tom J. Martin, Niagara Falls, NY (US); Clark Smith, Columbus, NE (US); Jeff Traikoff, Niagara Falls, NY (US)

(73) Assignee: VISHAY DALE ELECTRONICS, LLC, Columbus, NE (US)

( * ) Notice: Subject to any disclaimer, the term of this patent is extended or adjusted under 35 U.S.C. 154(b) by 113 days.

(21) Appl. No.: 14/563,560

(22) Filed: Dec. 8, 2014

(65) Prior Publication Data

US 2016/0163432 A1 Jun. 9, 2016

(51) Int. Cl.

| | |
|---|---|
| ***H01C 17/075*** | (2006.01) |
| ***H01C 7/00*** | (2006.01) |
| ***H01C 1/012*** | (2006.01) |
| ***H01C 1/142*** | (2006.01) |
| ***H01C 17/28*** | (2006.01) |

(52) U.S. Cl.

CPC ..... *H01C 17/075* (2013.01); *H01C 1/012* (2013.01); *H01C 1/142* (2013.01); *H01C 7/006* (2013.01); *H01C 17/283* (2013.01)

(58) Field of Classification Search

CPC ..... H01C 1/012; H01C 1/142; H01C 7/006; H01C 17/075; H01C 17/283

See application file for complete search history.

(56) References Cited

U.S. PATENT DOCUMENTS

| | | | |
|---|---|---|---|
| 4,152,689 | A | 5/1979 | Thompson |
| 4,677,413 | A | 6/1987 | Zandman et al. |
| 4,808,490 | A | 2/1989 | Tsukuda et al. |
| 5,966,067 | A | 10/1999 | Murakami et al. |
| 6,136,512 | A | 10/2000 | Doeling |
| 6,153,256 | A | 11/2000 | Kambara et al. |
| 6,201,290 | B1 | 3/2001 | Yamada et al. |
| 6,242,999 | B1 | 6/2001 | Nakayama et al. |

(Continued)

FOREIGN PATENT DOCUMENTS

| | | |
|---|---|---|
| EP | 1 271 566 A2 | 1/2003 |
| JP | H08-203713 A | 8/1996 |

(Continued)

OTHER PUBLICATIONS

Leyman, "Supersonic Particle Deposition (Cold Spray)," US Army Research Laboratory, Weapons & Materials Research Doctorate, HCAT Program Review Meeting, Jul. 20-21, 2004 (24 pages).

(Continued)

*Primary Examiner* — James Harvey

(74) *Attorney, Agent, or Firm* — Volpe and Koenig, P.C.

(57) ABSTRACT

A thin film resistor formed using thermal spraying techniques in the manufacturing process is provided. A thin film resistor and method of manufacturing a thin film resistor are disclosed including a thermally sprayed resistive element. An alloy bond layer may be applied to a substrate and a thermally sprayed resistive layer is applied to the alloy bond layer by a thermal spraying process to form a thermally sprayed resistive element. The alloy bond layer and the thermally sprayed resistive layer may have the same chemical composition.

30 Claims, 18 Drawing Sheets

(56) References Cited

U.S. PATENT DOCUMENTS

| | | | | |
|---|---|---|---|---|
| 6,428,630 | B1 | 8/2002 | Mor et al. | |
| 6,762,396 | B2 * | 7/2004 | Abbott | F27D 11/02 118/724 |
| 6,943,662 | B2 | 9/2005 | Tanimura | |
| 7,057,490 | B2 | 6/2006 | Hashimoto et al. | |
| 7,098,768 | B2 | 8/2006 | Doi | |
| 7,782,173 | B2 | 8/2010 | Urano et al. | |
| 7,839,000 | B2 | 11/2010 | Mis et al. | |
| 7,982,582 | B2 | 7/2011 | Belman et al. | |
| 8,514,051 | B2 | 8/2013 | Belman et al. | |
| 8,957,756 | B2 | 2/2015 | Belman et al. | |
| 2002/0031860 | A1 | 3/2002 | Tanimura | |
| 2002/0148106 | A1 | 10/2002 | Tsukada et al. | |
| 2003/0117258 | A1 | 6/2003 | Kim et al. | |
| 2004/0262712 | A1 | 12/2004 | Doi | |
| 2008/0094169 | A1 | 4/2008 | Kinoshita et al. | |
| 2009/0308454 | A1 | 12/2009 | Korevaar et al. | |
| 2011/0100975 | A1 | 5/2011 | Liu et al. | |
| 2011/0188838 | A1 * | 8/2011 | Abbott | F27D 11/12 392/407 |
| 2012/0126934 | A1 | 5/2012 | Belman et al. | |
| 2014/0308883 | A1 * | 10/2014 | Sung | B24B 53/017 451/443 |
| 2016/0035466 | A1 * | 2/2016 | Xu | H01C 1/14 338/20 |
| 2016/0145159 | A1 * | 5/2016 | Landwehr | C04B 41/52 428/448 |
| 2016/0163432 | A1 * | 6/2016 | Martin | H01C 17/075 338/308 |

FOREIGN PATENT DOCUMENTS

| | | | |
|---|---|---|---|
| JP | 2001 023801 | A | 1/2001 |
| JP | 2001 110601 | A | 4/2001 |
| JP | 2001 143905 | A | 5/2001 |
| JP | 2002 184602 | A | 6/2002 |
| JP | 2002-305126 | A | 10/2002 |
| JP | 2002 299203 | A | 11/2002 |
| JP | 2003-124004 | A | 4/2003 |
| JP | 2003-203801 | A | 7/2003 |
| JP | 2003-282302 | A | 10/2003 |
| JP | 2003-282304 | A | 10/2003 |
| JP | 2003-282305 | A | 10/2003 |
| JP | 2005-258302 | A | 9/2005 |
| JP | 2006 024767 | A | 1/2006 |
| JP | 2006-186064 | A | 7/2006 |
| JP | 2007-095926 | A | 4/2007 |
| JP | 2011-091140 | A | 5/2011 |
| JP | 2011-238730 | A | 11/2011 |

OTHER PUBLICATIONS

Sulzer Metco, "An Introduction to Thermal Spray," Issue 4, copyright 2012 (24 pages). The year of publication is sufficiently earlier than the effective U.S. filing date and any foreign priority date so that the particular month of publication is not in issue.

Inovati, "KM-Production Coating System," KM Data Sheet, Form PCS-10, copyright 2010 (1 page), downloaded from http://www.inovati.com/. The year of publication is sufficiently earlier than the effective U.S. filing date and any foreign priority date so that the particular month of publication is not in issue.

Gabel, Howard, "Kinetic Metallization Compared with HVO," Advanced Materials and Processes/ May 2004 (pp. 17 and 48).

Vishay Intertechnology, Inc., "Resistors 101," Instructional Guide, date code "VMN-SG2113-1205" referring to publication in 2012, pp. 1-8. The year of publication is sufficiently earlier than the effective U.S. filing date and any foreign priority date so that the particular month of publication is not in issue.

* cited by examiner

SECTION A-A

SECTION B-B

THERMALLY SPRAYED THIN FILM RESISTOR AND METHOD OF MAKING

FIELD OF THE INVENTION

The present invention relates to the field of resistors, and more particularly, to a thin film resistor made at least in part having thermally sprayed layers and using thermal spraying techniques.

BACKGROUND

Thin film resistors are typically manufactured by depositing resistive films of various alloys onto a non-conductive substrate. Typically, an aluminum oxide or aluminum nitride ceramic substrate is used, but other substrate materials can be used including, but not limited to, glass, diamond, ruby and metallic substrates having a non-conductive coating. The deposited films range in thickness from a few hundred Angstroms to several thousand Angstroms, depending on the desired sheet resistance.

Formation of the resistive films can be accomplished through a range of processes including plasma enhanced chemical vapor deposition (PECVD), chemical vapor deposition (CVD) or physical vapor deposition (PVD), with PVD being the most typical method used for thin film resistor manufacturing. Film deposition with a PVD process is typically performed in a vacuum environment. Deposition rates for a PVD process vary between about 0.005 to about 0.2 micrometers per minute for typical materials used in resistor manufacturing.

In thin film resistor design, the resistor value may be determined through the combination of the sheet resistance of the deposited film, measured in Ohms/Square, and the number of squares defined by the resistor geometry. For example, a 100 ohm resistor can be manufactured using a 50 ohm/square film and a design that has a two (2) square resistor geometry.

While PVD thin film technologies are effective at manufacturing precision resistors at nominal values of 10 ohms or above, the feasibility of creating lower resistance values, such as those in the range of about 10 ohms or less, or about 1 ohm or less, diminishes rapidly due to limitations in achieving the necessary film thicknesses in a practical and commercially reasonable time period. Accordingly, there is a need for a process for manufacturing a resistor that is faster than known techniques, yet is still precise, efficient and cost effective.

Thermal spraying is a process whereby heat is used to soften a material such as a metal or a ceramic, and then particles of the softened material are propelled, such as by a gas, onto a substrate to be coated. Other forms of energy, such as kinetic energy, may be used to accelerate the particles to a velocity whereby plastic deformation occurs when the particles impact the substrate. The particles form a dense coating/layer on the substrate as the particles agglomerate. The material to be thermally sprayed is sometimes referred to as the "feedstock." An example of equipment used for thermal spraying, and equipment that may be used for making a thin film resistor according to the present invention, is the Kinetic Metallization: Production Coating System, KM-PCS, offered by the Inovati Company of Santa Barbara, Calif.

Thermal spraying techniques can deposit metals at rates several times faster than PVD, PECVD or CVD processes generally used to form thin film resistors. For example, thermal spraying can deposit materials at a deposition rate of about at least 10 micrometers per minute. The high deposition rate of thermal spraying allows low value resistors to be made at a more competitive cost than known techniques. In contrast to thermal spraying, a PVD process cannot achieve the thicknesses required in a practical time period.

Thermal spraying, while typically performed in ambient conditions, can also be performed under a range of environments or conditions to control the oxide level and, to some extent, the structure of the thermally sprayed material. An advantage to spraying in ambient conditions is a reduction in processing time due to lack of required pump down time of a vacuum or other environmentally controlled system. Thermal spraying technologies available in the industry vary by the method of applying material, for example, the type of energy used and by the type of material used as the feedstock.

The present invention provides a means to address the time constraint and cost problems associated with deposition of resistive elements in thin film resistors using known techniques, by the application of thermal spraying technologies to the manufacture of thin film resistors.

SUMMARY OF THE INVENTION

In order to minimize the process time and cost in manufacturing thin film resistors, thermal spraying processes and technologies, typically used in a range of industries for rapid deposition of materials for mechanical wear purposes, corrosion resistance, restoration of surfaces and thermal barriers, may be used to deposit a resistive element on a substrate, and also to deposit other materials and layers, to form a thin film resistor, according to the teachings of the present invention.

It is therefore an object, feature, or advantage of the present invention to provide a thin film resistor that uses thermal spraying techniques in the manufacturing process.

According to an aspect of the present invention, a thin film resistor is provided comprising a thermally sprayed resistive element. The resistive element may be formed as a thermally sprayed layer comprising a material that has been thermally sprayed on at least a portion of the surface of a substrate or on a selected layer of the thin film resistor.

According to another aspect of the present invention, a thin film resistor is provided with an alloy bond layer deposited on at least a portion of the surface of a substrate. A thermally sprayed resistive layer is thermally sprayed on at least a portion of the alloy bond layer to form a thermally sprayed resistive element.

A method of making a thin film resistor is also provided. In an embodiment, a thin film resistor is formed by thermally spraying a selected material on a surface of a substrate, or on a selected layer of the thin film resistor, using a thermal spraying process to form a thermally sprayed resistive element.

In another aspect of the present invention, a method of manufacturing a thin film resistor is provided, wherein an alloy bond layer is applied to at least a portion of a surface of a substrate, and a thermally sprayed resistive layer is applied, by a thermal spraying process, to at least a portion of the alloy bond layer, to form a thermally sprayed resistive element.

In another aspect of the present invention, a thin film resistor is provided comprising a substrate having a first surface and an opposite second surface, an alloy bond layer deposited on at least a portion of the first surface of the substrate, and a thermally sprayed resistive layer thermally sprayed on at least a portion of the alloy bond layer.

Conductor pads are provided adjacent sides of the thermally sprayed resistive layer and extending along a portion of the alloy bond layer. The conductor pads may comprise first conductor layers and second conductor layers. Adhesion layers may be applied beneath the first conductor layers. An electrical connection is provided from a first surface of the resistor to a second opposite surface of the resistor. Alloy adhesion layers are applied extending from adjacent the conductor pads, along the sides of the substrate, and along portions of the second surface of the substrate. Third conductor layers may be applied over the adhesion layers. Additional fourth conductor layers may be applied over the third conductor layers. Barrier layers may be applied over the fourth conductor layers. A solder finish may be provided over the barrier layers.

In yet another aspect of the present invention, a method of forming a thin film resistor is provided, comprising the steps of: providing a substrate having a first surface, side surfaces, and a second surface opposite the first surface; depositing an alloy bond layer over at least a portion of the first surface; thermally spraying a thermally sprayed resistive layer over at least a portion of the alloy bond layer; forming conductor pads adjacent sides of the thermally sprayed resistive layer; providing an overcoat over exposed parts of the thermally sprayed resistive layer; and, electrically connecting the first surface and the second surface of the resistor.

Forming conductor pads may comprise the steps of: depositing adhesion layers adjacent sides of the thermally sprayed resistive layer and over portions of the alloy bond layer; depositing first conductor layers over the adhesion layers; and plating second conductor layers over the first conductor layers.

Providing an overcoat may comprise the steps of: providing a moisture passivation layer over at least a portion of the thermally sprayed resistive layer; and providing a mechanical protection layer over at least a portion of the moisture passivation layer.

Electrically connecting the first surface and the second surface may comprise the steps of: depositing adhesion layers adjacent the conductor pads, along portions of the first surface and sides of the substrate, and at least partially along portions of the second surface of the substrate; depositing third conductor layers over the adhesion layers; and, plating fourth conductor layers over the third conductor layers. Barrier layers may be applied over the fourth conductor layers, and solder may be applied over the barrier layers.

The alloy bond layer and the thermally sprayed resistive layer may have a similar chemical composition. The thermally sprayed resistive layer may be chemically bonded to an alloy bond layer selected to have a similar chemical composition. In another embodiment of the present invention, the alloy bond layer and the thermally sprayed resistive layer may have dissimilar chemical compositions.

In another aspect of the present invention, the thermally sprayed resistive layer is deposited by a thermal spraying process at a rate of about between about 10 to 60 micrometers per minute. In another aspect of the present invention, the thermally sprayed resistive layer is deposited by a thermal spraying process at a rate of about at least 10 micrometers per minute.

In another aspect of the present invention, the thermally sprayed resistive element comprises an alloy of copper, nickel, tantalum or titanium.

In another aspect of the present invention, the alloy bond layer comprises an alloy of copper, nickel, tantalum or titanium.

BRIEF DESCRIPTION OF THE DRAWINGS

A more detailed understanding may be had from the following description, given by way of example in conjunction with the accompanying drawings wherein.

DETAILED DESCRIPTION OF THE INVENTION

Figure 1:
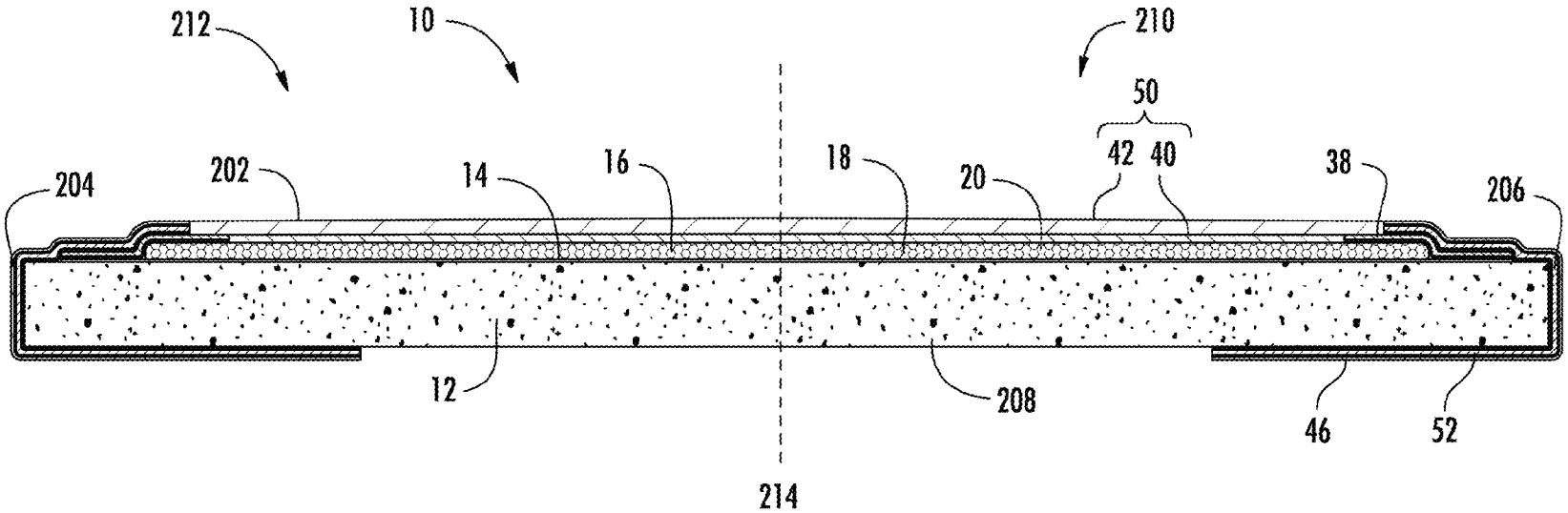
FIG. 1 shows a cross-sectional view of a film resistor according to an embodiment of the present invention.

The present invention is directed to the use and application of thermal spraying processes, techniques and technologies to the manufacture of thin film resistors. Table 1 provides a summary of typical thermal spraying processes, energy sources, environmental conditions, and the types of feedstock that may be used. Any of these methods could be used to achieve the rapid material deposition rates required for low resistance value thin film resistor manufacturing, as well as any others understood in the art to fall within the scope of thermal spraying.

TABLE 1

| Type of Thermal Spray Process | Type of Energy Source | Spray Process Environment | Type of Feedstock |
|---|---|---|---|
| Atmospheric Plasma Spray | High Temperature Plasma | Ambient | Powder |
| High Velocity Oxygen Fuel (HVOF) | High Temperature Combustion | Ambient | Powder |
| Electric Wire Arc | Thermal Energy From Wire Arc | Ambient | Wire |
| Cold Spray | Kinetic Energy | Ambient or Controlled Atmosphere | Powder |
| Combustion Wire Spray (Flame Spray) | Thermal Energy From Combustion Process | Ambient | Wire |
| Combustion Powder Spray (Flame Spray) | Thermal Energy From Combustion Process | Ambient | Powder |
| Controlled Atmosphere Plasma Spray | High Temperature Plasma | Controlled Atmosphere | Powder |

A thin film resistor according to an embodiment of the present invention is shown in FIGS. 1-6. The thin film resistor, as shown in the orientation of FIGS. 1-6, has a top or upper side 202 (or first side), opposite side ends 204 (left), 206 (right) (also referred to as "side faces"), and a bottom or lower side 208 (or second side). The right portion 210 of the resistor 10 shown to the right of center line 214 is essentially a mirror image of the left portion 212 of the resistor shown to the left of center line 214, as shown in the Figures. Thus, descriptions of the right portion 210 will also apply to the left portion 212, unless otherwise indicated.

A thin film resistor according to an embodiment of the present invention generally comprises a ceramic or non-metallic substrate 12, an alloy bond layer 14 deposited on the substrate 12, and a thermally sprayed resistive layer 18 thermally sprayed to the alloy bond layer 14. The material to be used in forming the thermally sprayed resistive layer 18 may be referred to herein as the "thermally sprayed material 16." The thermally sprayed material 16 will be used as the feedstock for a thermal spraying process, to apply, by thermal spraying, the thermally sprayed resistive element 20 of a finished resistor.

A potential difficulty with applying a thermally sprayed material to a ceramic or other non-metallic substrate lies in achieving a substantial bond strength, e.g., a bond that will not readily separate, between the thermally sprayed material and the underlying substrate or surface. For example, during the thermal spraying process on ceramic or non-metallic materials, a bond is achieved which is primarily mechanical. In typical thermal spraying applications, the surface of the substrate is grit blasted to remove oxides and to texture the surface thereby promoting mechanical adhesion between the feedstock and the substrate.

However, in the manufacture of thin film resistors, the thickness of the ceramic substrate ranges generally between about 0.010 inches to 0.025 inches thick. Grit blasting of ceramic or non-metallic substrates of such a thickness can result in distortion of the substrate well before a sufficient surface roughness is achieved. Thus, known grit blasting techniques are inappropriate, and generally inapplicable, to the process of making a thin film resistor.

In order to create a strong bond between the ceramic or non-metallic surface of the substrate 12 and the thermally sprayed material 16 that will form the thermally sprayed resistive element 20 of the resistor according to the present invention, an alloy bond layer 14 is deposited on the substrate 12. The alloy bond layer 14 may comprise, for example, a nickel chromium alloy. Other alloys may be used depending on the alloy used for the thermally spray material that will be applied. The alloy bond layer 14, may comprise, but is not limited to, alloys comprising nickel, tantalum, titanium, copper and aluminum, other known alloys suitable for use as the alloy bond layer, or combinations thereof. The alloy bond layer 14 is preferably applied by a PVD process, but it is appreciated that other thin film deposition technologies and/or processes may be used. By use of the alloy bond layer 14, grit blasting the substrate can therefore be avoided.

Figure 2:
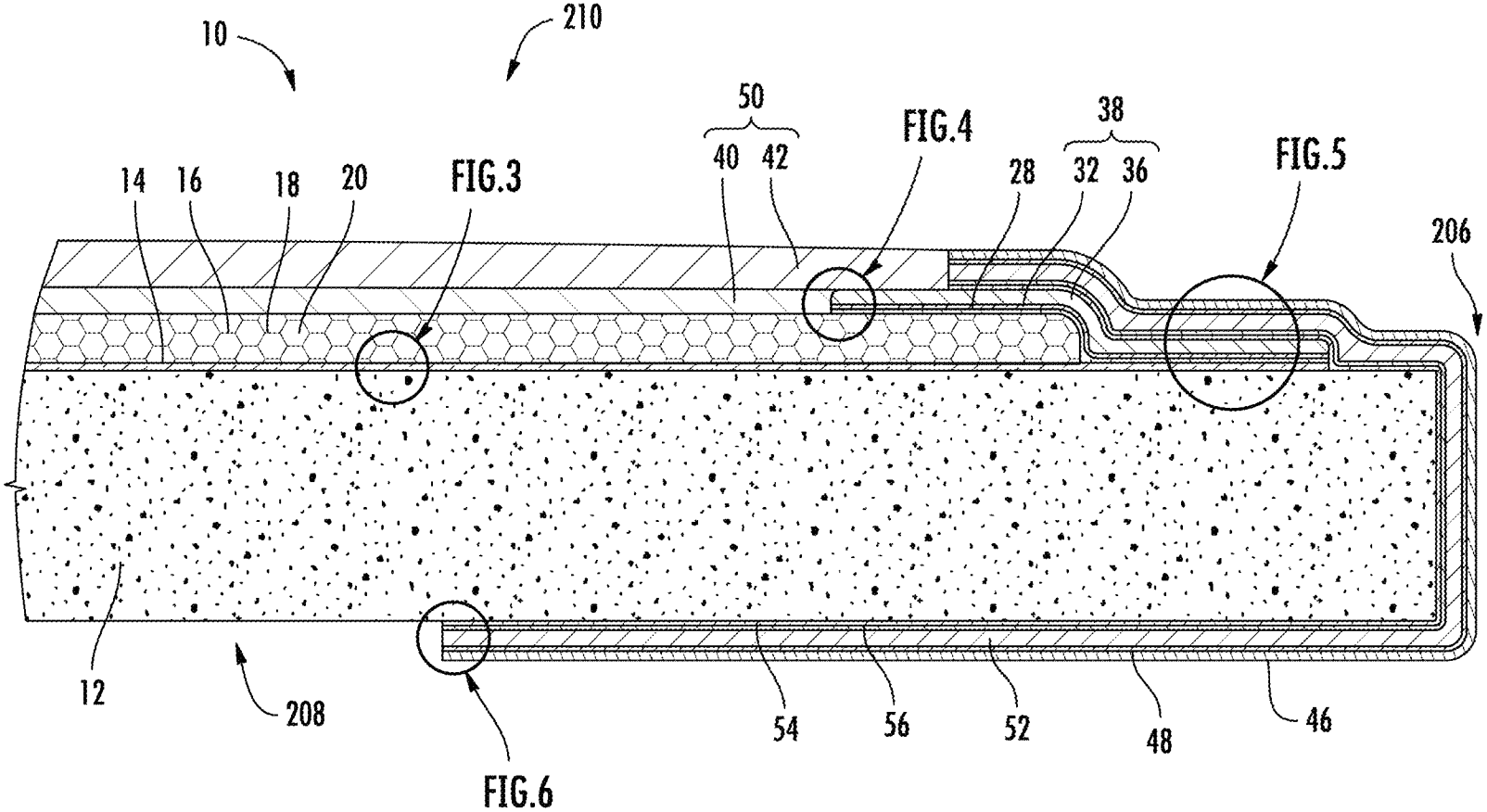
FIG. 2 shows an enlarged cross-sectional view of a portion of the film resistor according to an embodiment of the present invention shown in FIG. 1.
Figure 3:
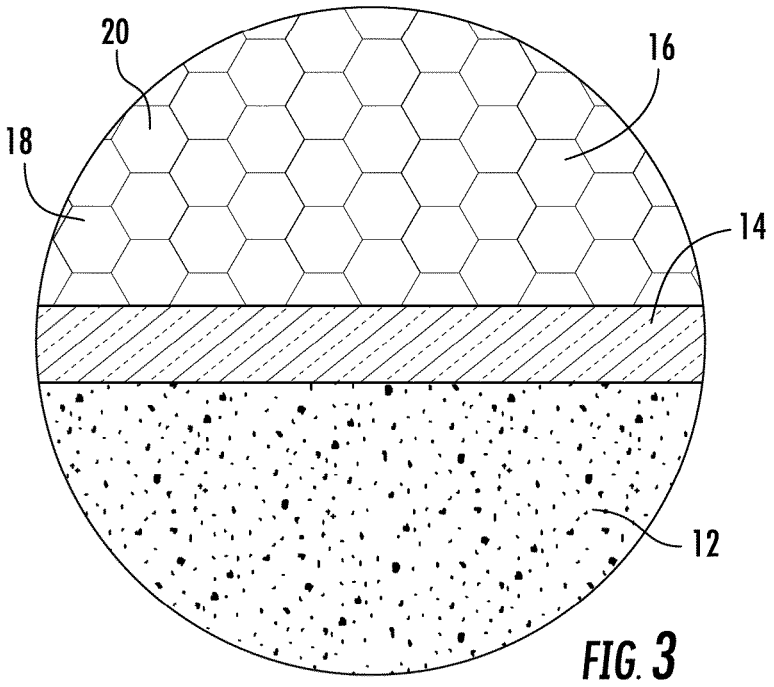
FIG. 3 shows an enlarged cross-sectional view of a portion of a resistor according to an embodiment of the invention designated as "FIG. 3" in FIG. 2.

FIGS. 1-3 show cross-sections of an exemplary resistor 10 fabricated according to an embodiment the present invention. As shown in FIGS. 2-3, an aluminum oxide or aluminum nitride ceramic substrate 12 is provided. It should be appreciated that any acceptable ceramic or other electrically non-conductive material for use in a thin film resistor may be used as the substrate 12. In addition, it is contemplated that metallic substrates that have an electrically non-conductive surface treatment may also be used.

As shown for example in FIGS. 2-3, the alloy bond layer 14 is deposited, such as by a PVD process, on the substrate 12. The alloy bond layer 14 preferably has a chemical composition similar to or complementary to the thermally sprayed resistive layer 18 that is to be applied. For example, if a copper, nickel, titanium or tantalum alloy is to be used to form the thermally sprayed resistive layer 18, a corresponding copper, nickel, titanium or tantalum alloy would be used for the alloy bond layer 14. In this manner, in a preferred embodiment of the invention, the alloy bond layer 14 and the thermally sprayed material essentially correspond and have the same or a similar chemical composition. Thus, if a nickel chromium alloy is used to form the alloy bond layer 14, the thermally sprayed material 16 may preferably be a nickel chromium alloy having the same or a similar chemical composition. In this manner, a chemical bond may be formed between the thermally sprayed material 16 and the material of the alloy bond layer 14.

The alloy bond layer 14 is preferably formed using a PVD process, though other vapor deposition processes including, but not limited to, PECVD or CVD may be used. The alloy bond layer 14 forms a strong mechanical bond with the ceramic or nonmetallic surface of the substrate 12.

Figure 13:
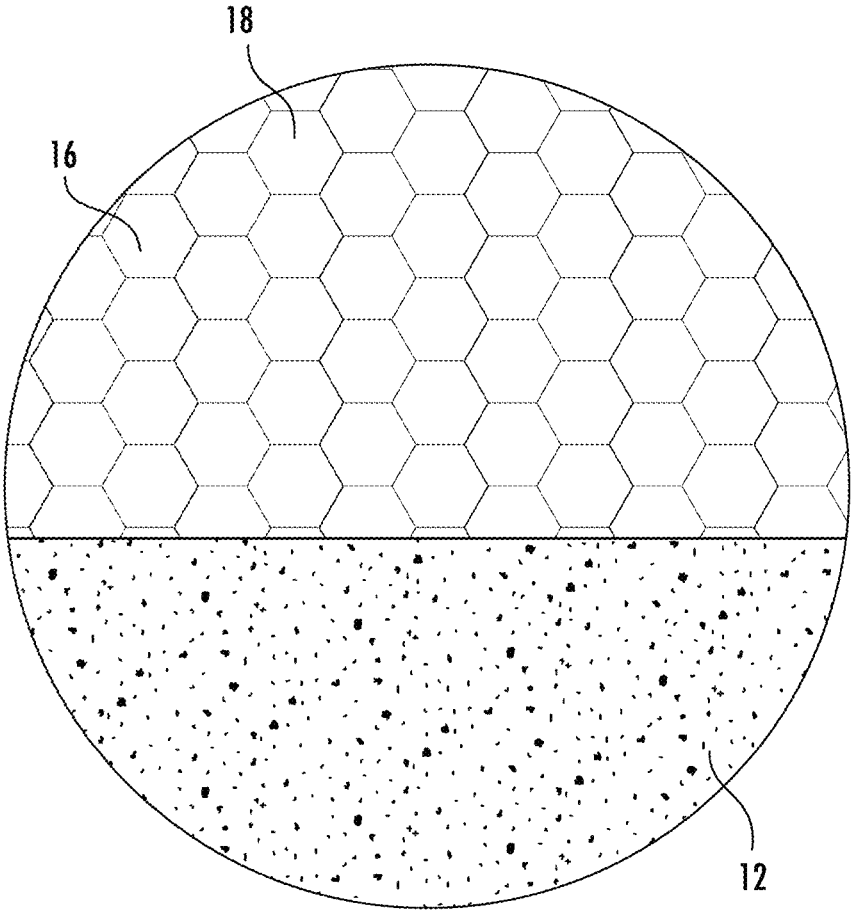
FIG. 13 is a cross-sectional view of a portion of an embodiment of a resistor according to the present invention, showing a thermally sprayed resistive layer thermally sprayed directly to a substrate.

As shown in FIGS. 2-3, a thermally sprayed material 16 is thermally sprayed onto the alloy bond layer 14 to form a thermally sprayed resistive layer 18. The thermally sprayed resistive layer 18 forms a thermally sprayed resistive element 20, the size and shape of which can be adjusted during the manufacturing process. During the application of the thermally sprayed resistive layer 18 by a thermal spraying process, such as any described above or others known in the art, a chemical bond is formed between the thermally sprayed material 16 and the alloy bond layer 14 due to the similarities in their chemical composition. The thermally sprayed resistive element can be sprayed, for example, to a thickness of at least 3.94 mils (100 micrometers). While the use of an alloy bond layer 14 may be preferred, it is appreciated that a resistor may be formed on a substrate 12 according the principles of the present invention by using a thermal spraying process alone, without use of the alloy bond layer 14, as an alternate embodiment. For example, as shown in FIG. 13, an alternate embodiment of a resistor may be formed according to the present invention with a thermally sprayed material 16 thermally sprayed directly to a substrate 12 of the resistor, without the use of an alloy bond layer 14.

Figure 7:
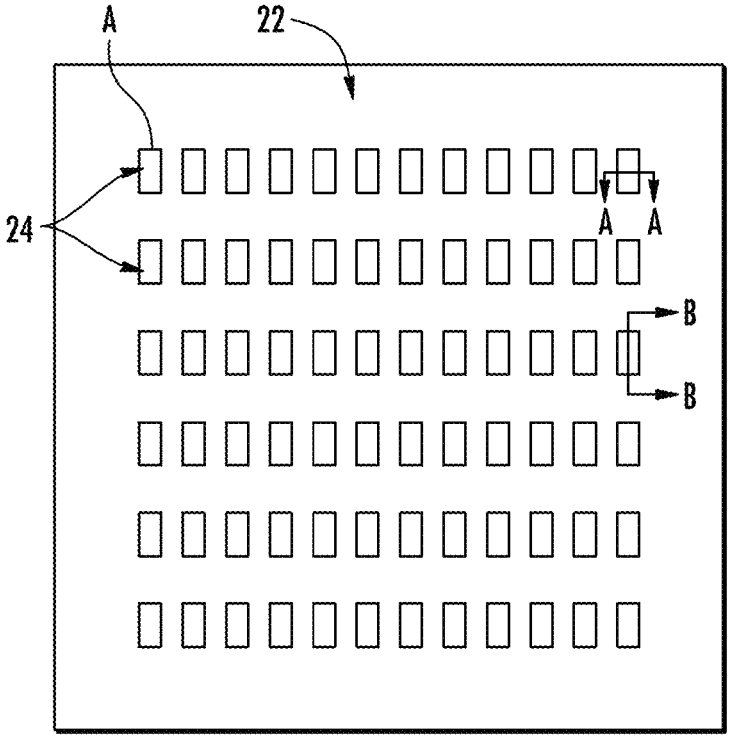
FIG. 7 shows a top plan view of an exemplary mechanical mask for use in applying an alloy bond layer and thermally sprayed layer to a resistor according to the present invention.
Figure 7A:
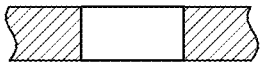
FIG. 7A shows a cross-sectional view of the width of an opening in the mechanical mask shown in FIG. 7, taken along line A-A in FIG. 7.
Figure 7B:
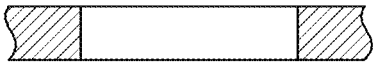
FIG. 7B shows a cross-sectional view of the length of an opening in the mechanical mask shown in FIG. 7, taken along line B-B in FIG. 7.

In order to define the area where the alloy bond layer 14 and/or thermally sprayed material 16 are to be applied, mechanical masking may be used. This mechanical masking, shown in FIGS. 7A and 7B, defines the net resistor area A which in turn defines the resistance value of the subject resistors. A mechanical mask 22 is placed over the substrate. By tailoring the size of the mechanical mask openings 24, the resistor area A and the ultimate resistance value can be defined. The size of the mechanical mask opening 24 can be selected to achieve a resistor area A having a particular resistance value. Accordingly, a method for selecting a specific resistance value is provided as part of the thermal spraying process described herein. This method is shown schematically in FIG. 12, with the steps leading up to the thermally sprayed process to follow. The process can then proceed to the additional steps shown in FIGS. 9-11, described in greater detail below. A thin film resistor according to the present invention may have a low resistance value such as a resistance value of about 10.0 ohms or less, or a resistance value of about 1.0 ohms or less.

Further geometry modifications can be made to the thermally sprayed resistive element 20, during deposition, using varying hard mask geometries and after deposition using chemical etching, laser machining and/or grinding or abrasive machining. Modification of these geometries affects the resistor area A and hence the electrical properties of the finished device. The geometry of the thermally sprayed resistive element 20 can be selected to achieve a particular selected geometry having particular selected electrical properties. Examples of geometries that may be used for the thermally sprayed resistive element 20 include a block pattern, a serpentine pattern, a top hat pattern, and a ladder pattern. Accordingly, a method for selecting a resistive material geometry to achieve specific electrical properties is provided as part of the thermal spraying process and method of forming a thin film resistor as described herein.

Figure 4:
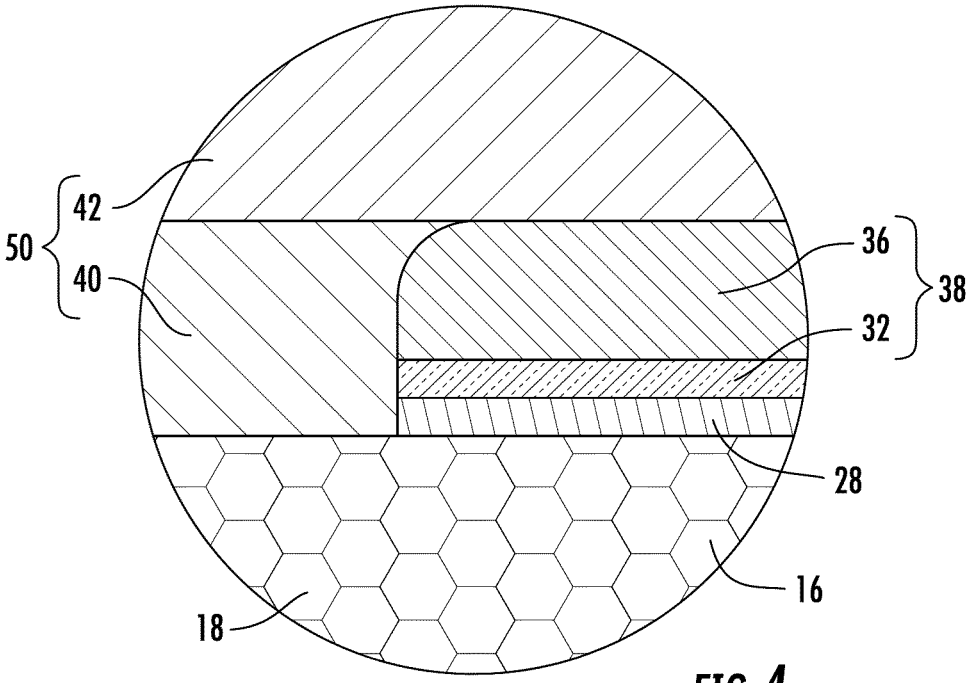
FIG. 4 shows an enlarged cross-sectional view of a portion of a resistor according to an embodiment of the invention showing the area designated as "FIG. 4" in FIG. 2.

Once the alloy bond layer 14 and thermally sprayed resistive layer 18 are applied to the substrate 12, conductor pads 38, which may be single or multiple layers, as shown in FIGS. 1, 2 and 4, may be formed to create a connection to the thermally sprayed resistive element 20 and thereby permit testing the properties of the thermally sprayed resistive element 20. To accomplish this, as shown in greater detail in FIGS. 2 and 4, a vapor deposited adhesion layer 28 of an alloy, for example, an adhesion layer 28 of a titanium alloy applied by, for example, a PVD process, is applied to a previously applied thermally sprayed resistive layer 18. A first conductor layer 32, for example a first conductor layer 32 comprising gold, is preferably vapor deposited such as by PVD on the previously applied adhesion layer 28. A photoresist may then be applied to the previously applied layers and patterned to further define an additional layer, if desired, of the conductor pads 38. Once the areas where optional additional layers of the conductor pads 38 will be formed are defined, plating may be used to form a second conductor layer 36, comprising, for example, gold, and the photoresist is removed. Alternately, the second conductor layer 36 may be formed by thermal spraying. With the photoresist removed, the conductor pads 38, which may be one or multiple layers, and the adhesion layer 28 may be etched, forming separate block resistors comprising the previously described thermally sprayed resistive layer 18 comprising, for example, nickel chromium alloy, with conductor pads 38, which may comprise gold, at the end of each block.

As shown in FIGS. 1-6, a portion of a cross-section of a thin film resistor 10 is shown, with a thermally sprayed resistive layer 18 formed from thermally sprayed material 16 comprising, for example, copper, nickel, titanium or tantalum, or alloys thereof. The thermally sprayed resistive layer 18 forms a thermally sprayed resistive element 20 of a finished resistor. The thermally sprayed resistive element 20 is thus made up of feedstock particles, "drops," "splats" or "lamellae" of the thermally sprayed material 16, formed by the liquefied droplets or plastically deformed particles of the thermally sprayed material 16 selected. The thermally sprayed resistive element 20 will demonstrate the properties of a thermally sprayed coating using the thermal spraying techniques described herein, or related thermal spraying techniques. Thus, the thermally sprayed resistive element 20 will comprise particles demonstrating mechanical interlocking or bonding, diffusion bonding, metallurgical bonding, or other adhesive, chemical or physical bonding properties, or combinations of these, depending on the nature and composition of the particles of the thermally sprayed material 16. Whereas known methods of depositing a resistive element of a thin film resistor can deposit a resistive element at rates for a PVD process varying between about 0.005 to 0.2 micrometers per minute for typical materials used in thin film resistor manufacturing, using a thermal spraying process, a thermally sprayed resistive element can be deposited at a rate of between about 10 to 60 micrometers per minute, to form a thin film resistor as described herein.

While formation of the conductor pads 38 may be accomplished using a vapor deposited adhesion layer and seed layers (e.g., the PVD deposited layers that are used to initiate the electrolytic plating process, such a PVD deposited gold layer thick enough to initiate the electrolytic gold plating process), followed by, for example, a plating process, other processes and materials may be used to form the conductor pads 38. For example, an additional mechanical mask and an additional thermal spraying process may be used to form the conductor pads 38.

Figure 15:
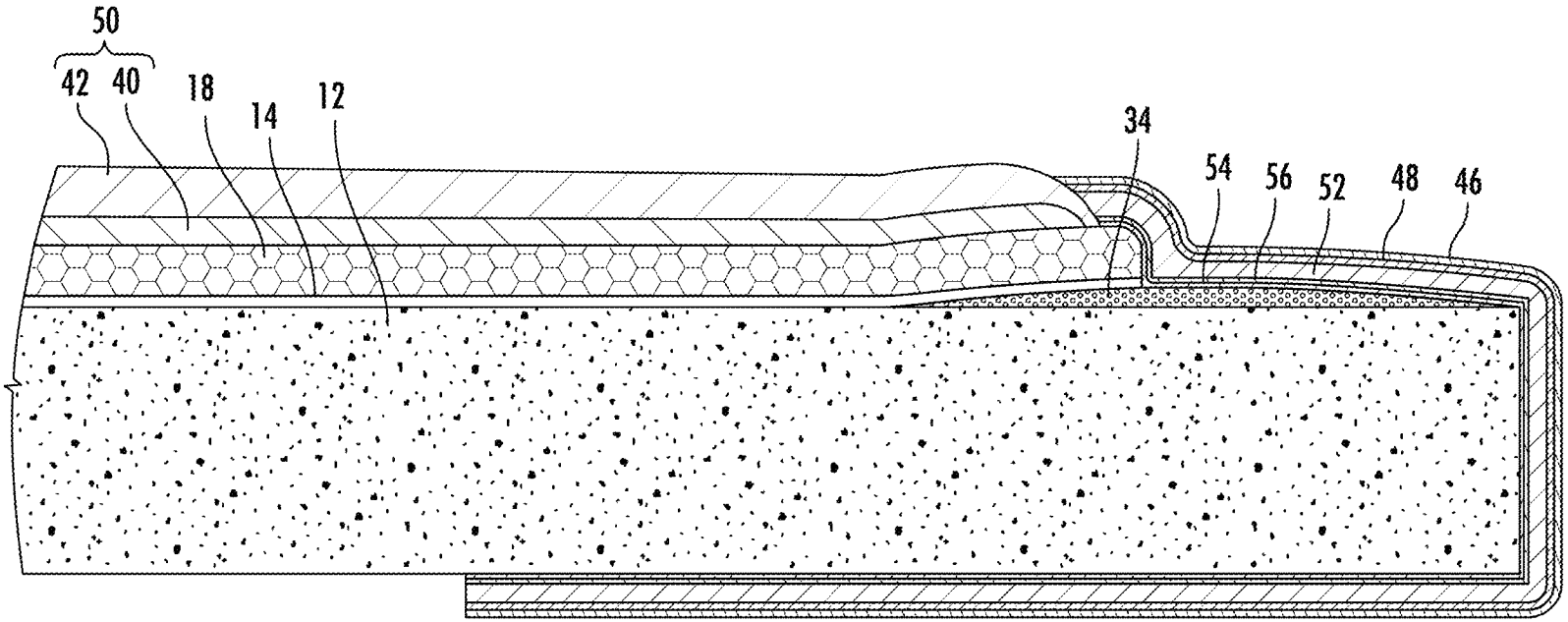
FIG. 15 is a cross-sectional view of a portion of an embodiment of a resistor according to the present invention, showing a thick film conductor.
Figure 16:
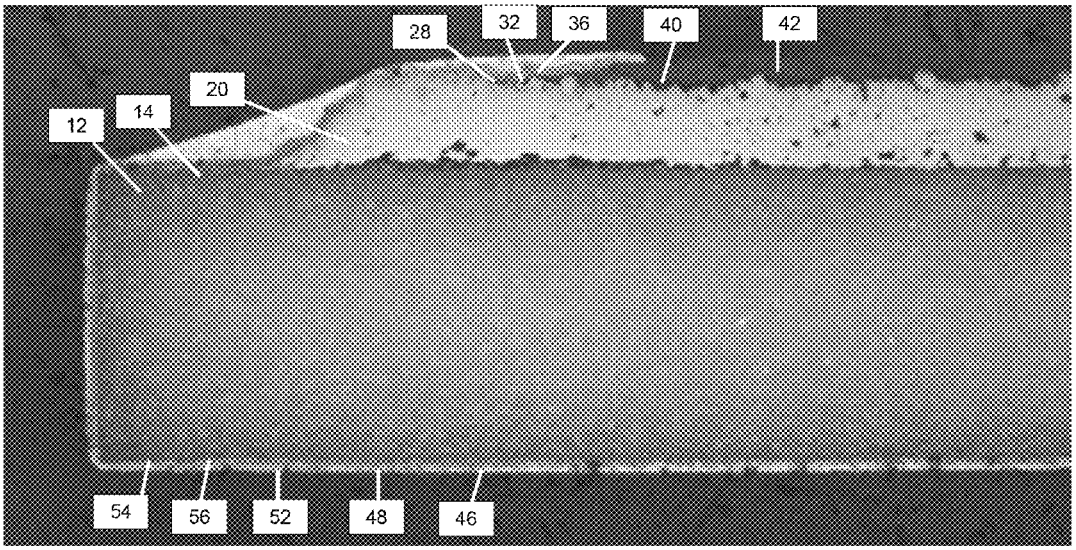
FIG. 16 is an image of a cross-section of a portion of an exemplary resistor made according to the teachings of the present invention, using bright field illumination at 5× magnification.
Figure 17:
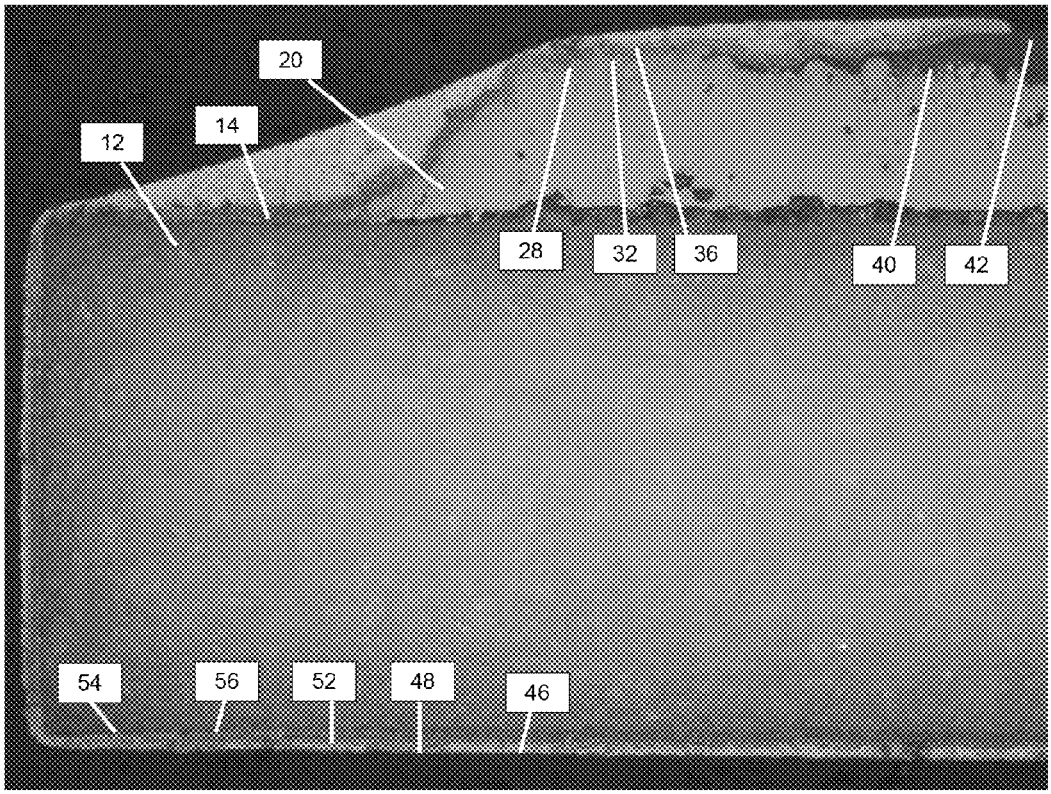
FIG. 17 is an image of a cross-section of a portion of the exemplary resistor of FIG. 16, using bright field illumination at 10× magnification.
Figure 18:
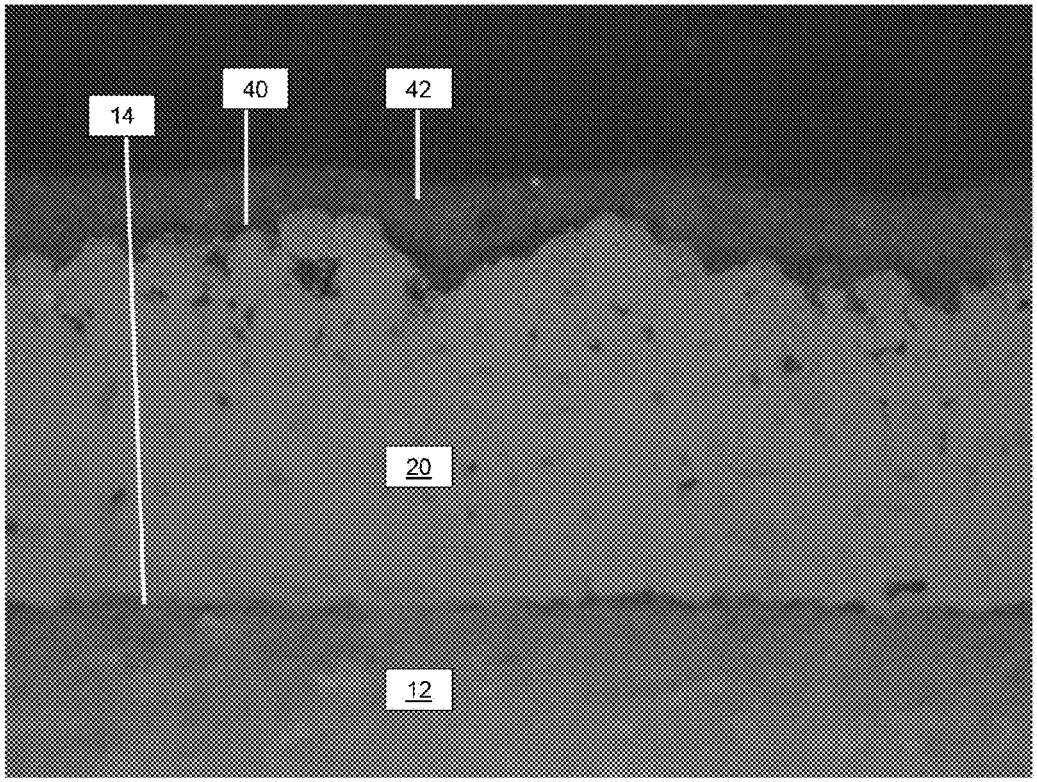
FIG. 18 is an image of a cross-section of a portion of the exemplary resistor of FIG. 16, using bright field illumination at 25× magnification.
Figure 19:
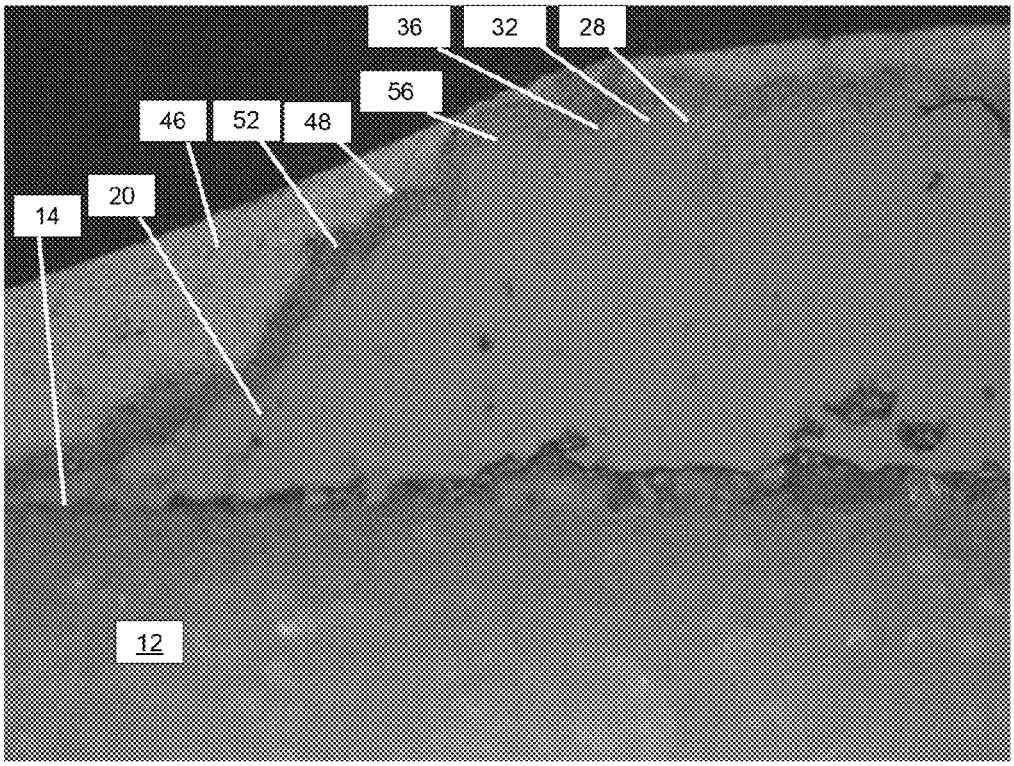
FIG. 19 is an image of a cross-section of a portion of the exemplary resistor of FIG. 16, using bright field illumination at 25× magnification.

Alternately, as shown in FIG. 15, a typical thick film technology process as known in the art may be used to apply thick film conductor pads 34 to the surface of the substrate 12 prior to depositing the resistive materials. Thick film materials and processes are used to make thick film chip resistors, resistor networks, hybrid substrates, and other electronic components and circuits. In the case of a thermally sprayed resistor, a thick film conductor material could be screen printed onto a bare ceramic substrate as a thick film conductor layer 34, and subjected to a firing process to melt the inorganic binders in the thick film paste, thereby bonding the thick film conductor layer 34 to the substrate 12. Thick film conductors may contain silver or silver alloys, copper, or gold as the conductive phase, and an inorganic binder such as glass to bond the conductive phase to the substrate. With the thick film conductor pads 34 applied, such thick film conductor pads 34 being one or multiple layers, an alloy bond layer 14 may be applied, using a range of known methods, overlapping onto the thick film conductor pad 34. With the alloy bond layer 14 in place, the thermally sprayed resistive layer 18 would be applied using a mechanical mask such as described.

Termination patterns or designs can be varied to modify the resistor geometry in order to increase or decrease the square count of the resistor and to impact or otherwise control the electrical properties of the finished resistor. The geometry of the thermally sprayed resistive element 20 may be modified using laser trimming and/or machining processes to achieve the desired resistance value. While laser trimming may be used, other processes may be used including, but not limited to, chemical etching, grinding or abrasive machining, to establish the final resistance value. After the final resistance value is obtained, an overcoat 50 may be applied to the thermally sprayed resistive layer 18 comprising a moisture passivation layer 40 and a mechanical protection layer 42. The moisture passivation layer 40 may be, for example, a polymer, while the mechanical protection layer 42 may be, for example, an epoxy. Those of skill in the art will recognize various polymers and similar compositions that may be used in forming an overcoat.

As shown for example in FIGS. 1, 2 and 5-6, with the overcoat 50 applied, an electrical connection from the upper side 202 of the device to the bottom side 208 of the devices is made by one or more additional layers. As shown for example in FIGS. 2 and 5-6, this may be accomplished using a PVD process to apply a nickel alloy adhesion layer 54 followed by a nickel alloy conductor layer 56 (which may also be considered and/or referred to as a third conductor layer) overlapping the conductor pads 38 and extending around the end of the device onto the bottom of the substrate 12. Once the PVD adhesion layer 54 and third conductor layer 56 are deposited, a fourth conductor layer 52, for example, copper, may be plated to the desired thickness followed by a nickel barrier layer 48. The final plating step may be the application of a tin/lead or lead free solder 46 finish. While PVD deposited nickel alloys were used for the adhesion layer 54, followed by a plated copper conductor layer 52, alternative processes and materials may be used to form the connection from the upper side 202 to the bottom side 208 of the device.

As shown in FIGS. 1-6, in an embodiment of a resistor of the present invention, the alloy bond layer 14 extends along a majority of the upper surface of the substrate 12. The thermally sprayed resistive element 20 extends along a majority of the alloy bond layer 14. The adhesion layer 28 and conductor pads 38 are positioned on opposite side ends of the thermally sprayed resistive element 20, and at least partially overlap an upper surface of the thermally sprayed resistive element 20 at the opposite side ends. The adhesion layer 28 and conductor pads 38 may extend toward the side ends 204, 206 of the resistor 10 and to adjacent the end of the alloy bond layer 14. The parts of the thermally sprayed resistive element 20 that remains exposed after the adhesion layer 28 and conductor pads 38 are applied may be covered by the moisture passivation layer 40, which can extend along a length of an upper surface of the thermally sprayed resistive element 20 to adjacent the adhesion layers 28 and conductor pads 38, and may at least partially cover an upper surface the conductor pads 38. The mechanical protection layer 42 covers an upper surface of the moisture passivation layer 40, and may completely cover the moisture passivation layer 40. The mechanical protection layer 42 may also extend to cover edges of the upper surface of the conductor pads 38. The adhesion layer 54, third conductor layer 56, fourth conductor layer 52, barrier layer 48 and solder layer 46 may have a first end adjacent to and abutting the moisture passivation layer 40 and mechanical protection layer 42, extending around the side ends 204, 206, and extending along at least a portion of the bottom 208 of the resistor, as shown for example in FIGS. 1 and 2.

Figure 14:
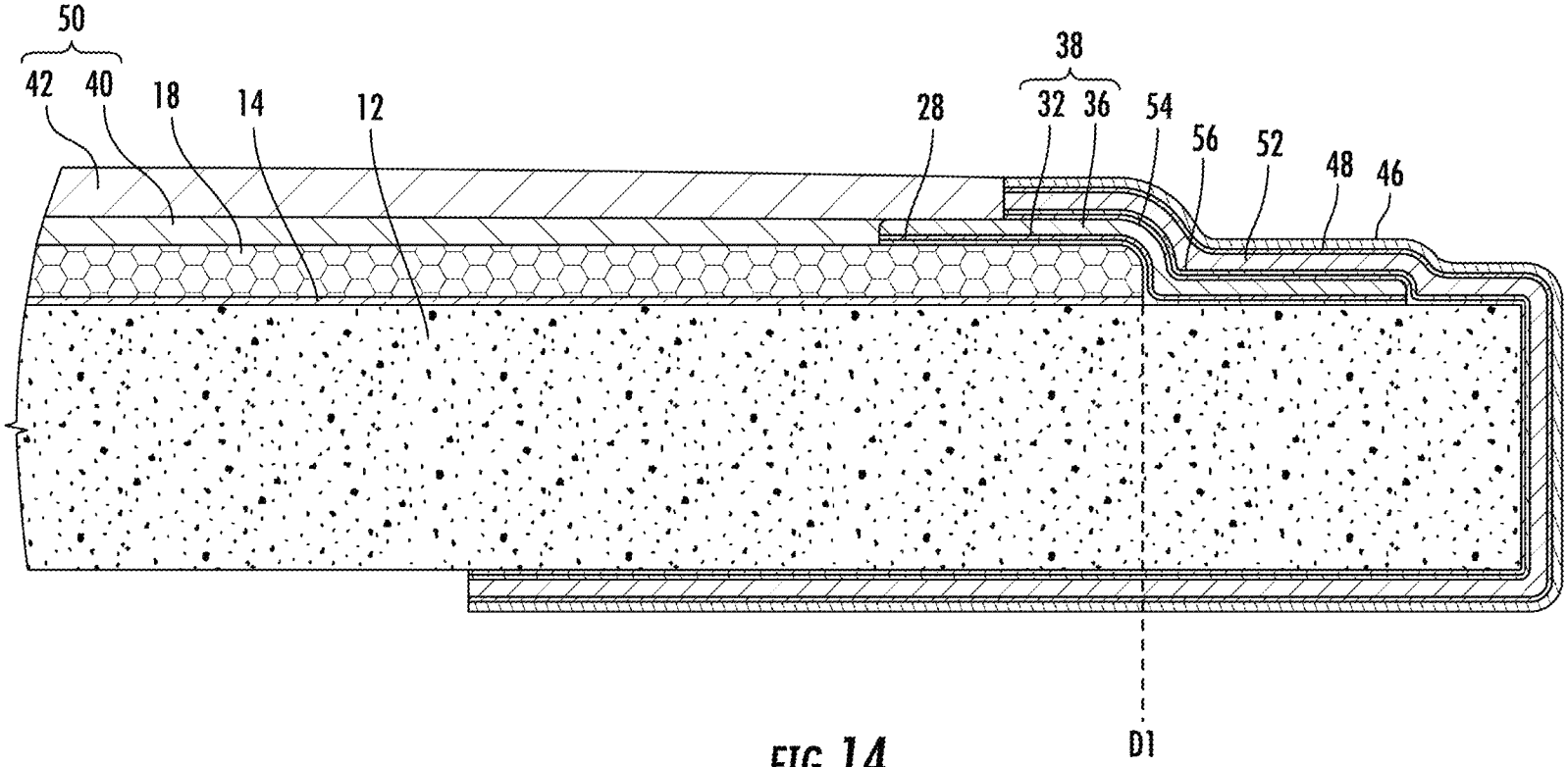
FIG. 14 is a cross-sectional view of a portion of an embodiment of a resistor according to the present invention, showing the alloy bond layer extending along a portion of the upper surface of the substrate.

In another embodiment, shown in FIG. 14, rather than extending beneath the conductor pads 38 as in FIG. 14, the alloy bond layer 14 can alternately extend a shorter distance (shown extending to line D1 in FIG. 14) along the upper surface of the substrate and extending directly beneath the thermally sprayed resistive layer 18, but not extending beneath the adhesion layer 28. In the embodiment of FIG. 14, the adhesion layer 28 is applied directly to the substrate 12 on opposite sides of the alloy bond layer 14 and thermally sprayed resistive layer 18, and the additional layers may be applied and positioned as described in connection with FIGS. 1-6, and as shown in FIG. 14.

Figure 9:
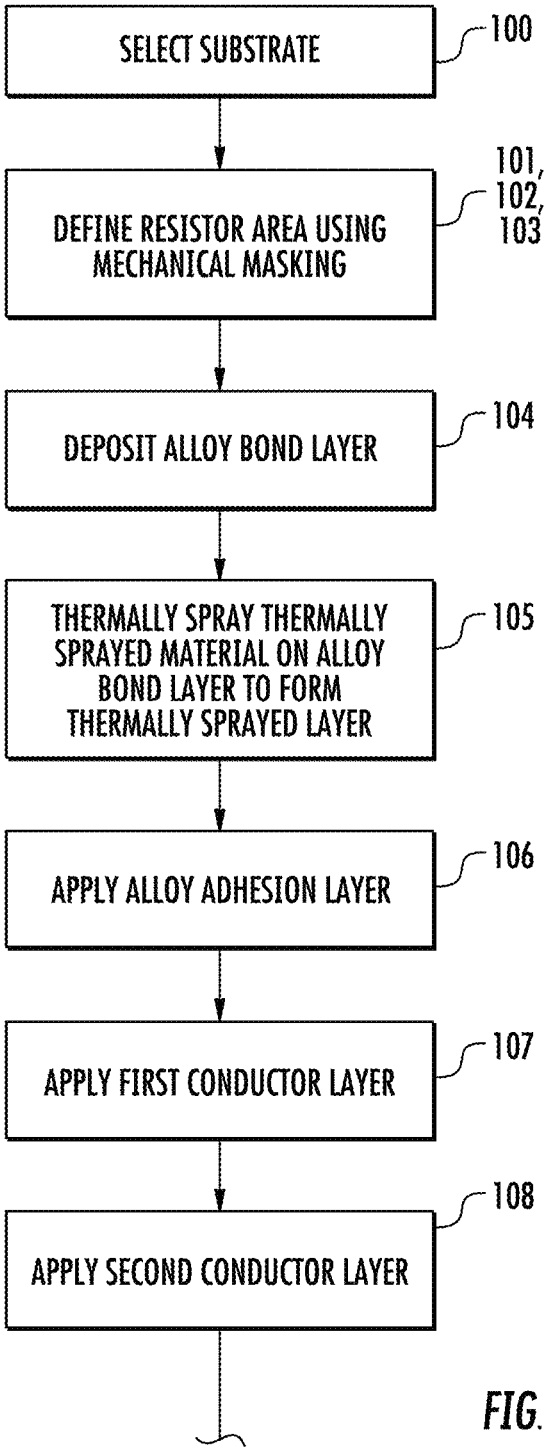
FIG. 9 is a flow diagram illustrating a part of a manufacturing process of an embodiment of a thin film resistor of the present invention.
Figure 10:
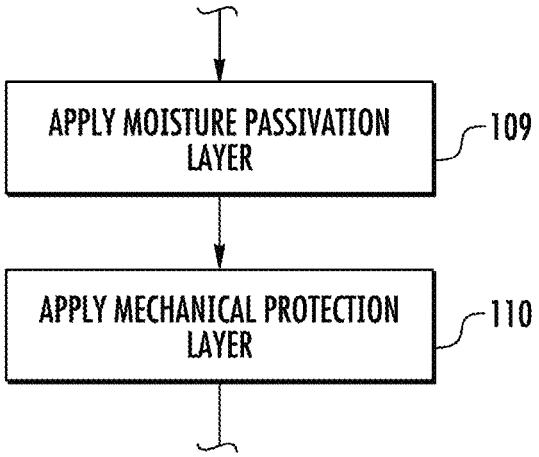
FIG. 10 is a flow diagram illustrating a part of a manufacturing process of an embodiment of a thin film resistor of the present invention.
Figure 11:
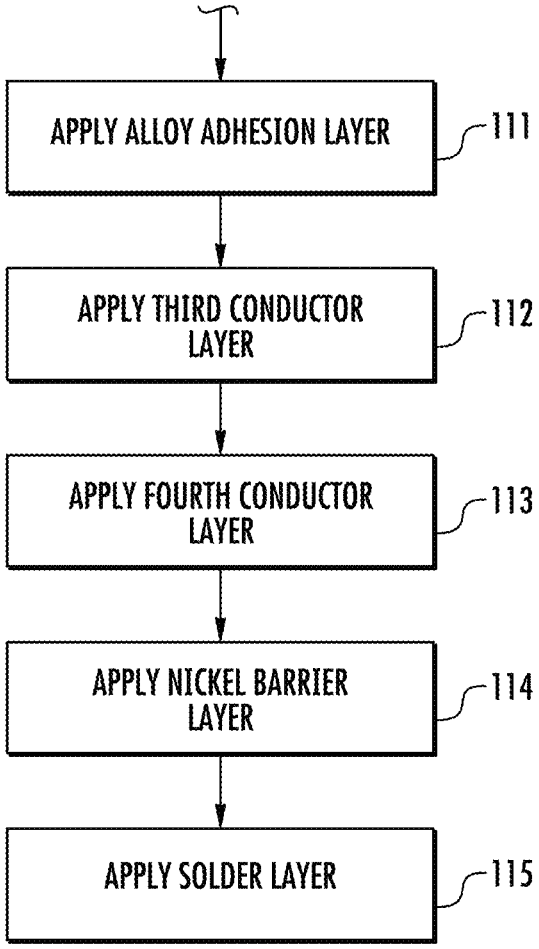
FIG. 11 is a flow diagram illustrating a part of a manufacturing process of an embodiment of a thin film resistor of the present invention.
Figure 12:
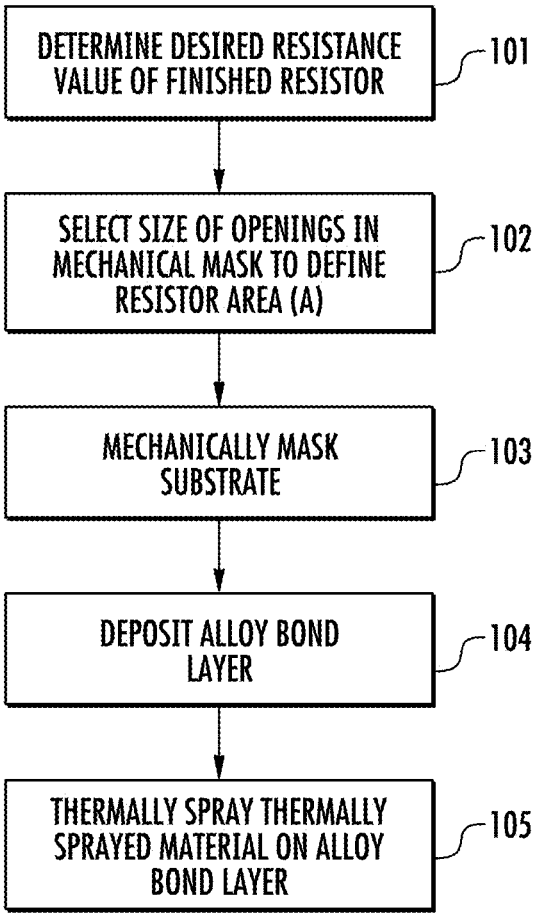
FIG. 12 is a flow diagram illustrating a part of a manufacturing process of an embodiment of a thin film resistor of the present invention.

An exemplary method of manufacturing a thin film resistor according to the teachings of the present invention is shown diagrammatically in FIGS. 9-11. As shown in FIG. 9, in step 100, a substrate 12 is selected. The substrate 12 may be, for example, an aluminum oxide or aluminum nitride substrate. In step, 103, a mechanical mask is positioned to define the resistor area A and therefore the resistive value V of the resistor. The size of the resistor area A and selection of the size of the mechanical mask openings 24 to provide a particular resistor value V can be provided according to steps 101-103 of FIG. 12. Using mechanical masking techniques, in step 104, the alloy bond layer 14 is deposited. The alloy bond layer 14 may be a thin film nickel alloy applied by a PVD process. In step 105, a thermal spraying process is used to spray the thermally sprayed material 16 on the alloy bond layer 14, to form a thermally sprayed resistive layer 18. The thermally sprayed material 16 may be a copper alloy, nickel alloy, titanium alloy or tantalum alloy. In an exemplary process of manufacturing a thin film resistor according to the present invention, a nickel alloy bond layer 14 is used, and is then thermally sprayed with a nickel alloy thermally sprayed material 16.

To form conductor pads 38, as shown in step 106, an alloy adhesion layer 28 is deposited on a top or first surface of the thermally sprayed resistive layer 18 adjacent the opposite side ends of the thermally sprayed resistive layer 18. The alloy adhesion layer 28 is also applied to at least a portion of a top or first surface of the alloy bond layer 14 on opposite sides of the thermally sprayed resistive layer 18, as shown in FIGS. 1 and 2. The alloy adhesion layer 28 may be a PVD applied thin film titanium alloy.

As shown in FIG. 9, the steps for formation of conductor pads 38 are shown diagrammatically. In step 107, a first conductor layer 32 is applied over the alloy adhesion layer 28. The first conductor layer 32 may be a PVD applied thin film gold or copper conductor layer. In step 108, a second conductor layer 36 is applied over the first conductor layer 32. The second conductor layer 36 may be gold or copper, and may be applied by thermal spraying or plating techniques.

Turning to FIG. 10, the overcoat 50 is applied along a length of the upper surface of the thermally sprayed resistive layer 18 and covering the majority of the thermally sprayed resistive layer 18, and portions of the conductor pads 38, as shown in FIGS. 1 and 4. In step 109, the moisture passivation 40 is applied. The moisture passivation layer 40 may be applied by screen printing. The moisture passivation layer 40 covers a length, which may be a majority of the length, of the upper surface of the thermally sprayed resistive layer 18, and may extend adjacent to and may overlap edge portions of the conductor pads 38, as shown in FIG. 4. In step 110, the mechanical protection layer 42 is applied, such as by screen printing. The mechanical protection layer 42 covers a central portion of the moisture passivation layer 40, and may also cover portions of the top surface of the conductor pads 38 adjacent to the moisture passivation layer 40, as shown in FIGS. 1, 2 and 4. The overcoat 50 assists in sealing and protecting portions of the upper surface of the resistor.

Turning to FIG. 11, an electrical connection is provided from the top side 202 of the resistor (in the orientation shown in the Figures) to the bottom side 208 of the resistor. In step 111, a nickel alloy adhesion layer 54 is applied to the substrate, extending along a top surface of the substrate 12 adjacent the side ends of the alloy bond layer 14, along opposite side surfaces of the substrate, and along portions of the bottom surface of the substrate 12, as shown in FIGS. 1, 2, 5 and 6. The alloy adhesion layer 54 may be a nickel alloy, and applied by a PVD process. In step 112, a third conductor layer 56 is applied over the alloy adhesion layer 54 and extending from adjacent opposite ends of the mechanical protection layer and overlapping opposite top surfaces of the conductor pads 38, along opposite side surfaces of the substrate, and along portions of the bottom surface of the substrate 12, as shown in FIGS. 1, 2, 5 and 6. The third conductor layer 56 may be a PVD applied thin film nickel alloy conductor layer. In step 113, a fourth conductor layer 52 is applied overlapping the third conductor layer 56, as shown in FIGS. 1, 2, 5 and 6. The fourth conductor layer 52 may be plated nickel or copper. In step 114, a nickel barrier layer is applied, such as by plating. In step 115, a finishing solder layer 46 is applied, which may be "hot dipped" or plated tin or tin/lead alloy.

It is appreciated that the steps shown in FIGS. 9-12 can take place in an order accommodating the fabrication and manufacturing needs and equipment of a thin film resistor manufacturer. FIGS. 9-12 show steps of manufacturing a thin film resistor according to the present invention in an illustrative order, however, there may be variations in the order. In addition, those of skill in the art of thin film resistors will appreciate that several manufacturing variables (e.g., type of equipment used, pressure, temperature, environment) may be used and/or otherwise adjusted during various steps in the manufacturing process.

It is further appreciated that, while various adhesion, bond and conductor layers have been described, not all are necessary in order to create a resistor according to the present invention. Examples of variations in the layers include, but are not limited to, the following.

As shown in FIG. 13, a thermally sprayed resistive layer 18 may be applied directly to the surface of a substrate 12, to form thermally sprayed resistive element, without the use of an alloy bond layer 14. The resistor may be further fabricated using additional layers and processes as described herein.

The conductor pads 38 may be formed by applying a thermally sprayed alloy directly to the thermally sprayed resistive layer 18 to form the conductor pads 38, without applying an adhesion layer 28.

Figure 20:
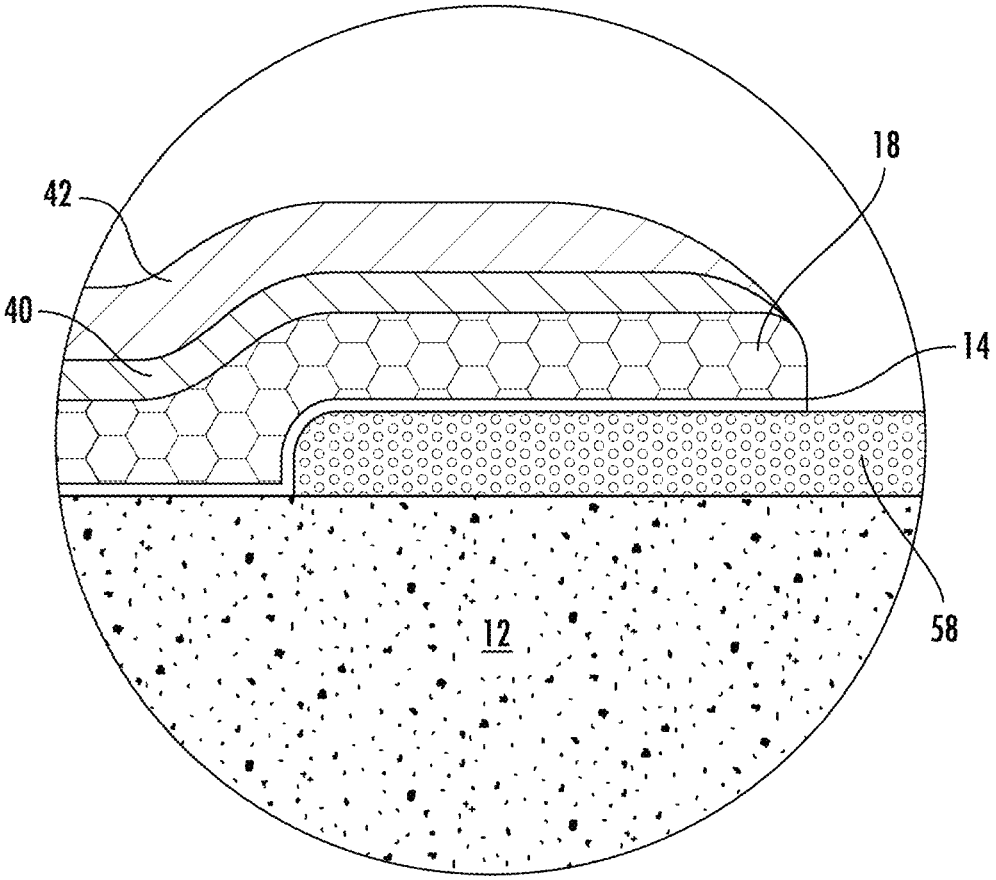
FIG. 20 is a cross-sectional view of a portion of an embodiment of a resistor according to the present invention, showing a thermally sprayed conductor layer.

As shown in FIG. 20, a thermally sprayed alloy may be applied directly to the surface of the substrate 12 to form a thermally sprayed conductor layer 58, prior to applying the alloy bond layer 14, with the thermally sprayed conductor layer 58 acting as the conductor pads. The alloy bond layer 14 may then be applied directly to the surface of the substrate 12, overlapping onto the thermally sprayed conductor layer 58. The thermally sprayed alloy is then applied to the surface of the alloy bond layer 14 including an area of overlap on the thermally sprayed conductor layer 58. Various additional layers as described herein may be also applied.

A PVD applied copper alloy conductor layer may be applied directly to the surface of the conductor pad 38, extending onto the surface of the substrate 12, around the side ends 204, 206 of the resistor and onto the bottom of the substrate 12, thereby replacing the nickel alloy adhesion layer 28 and the nickel alloy conductor layer 32.

Figure 5:
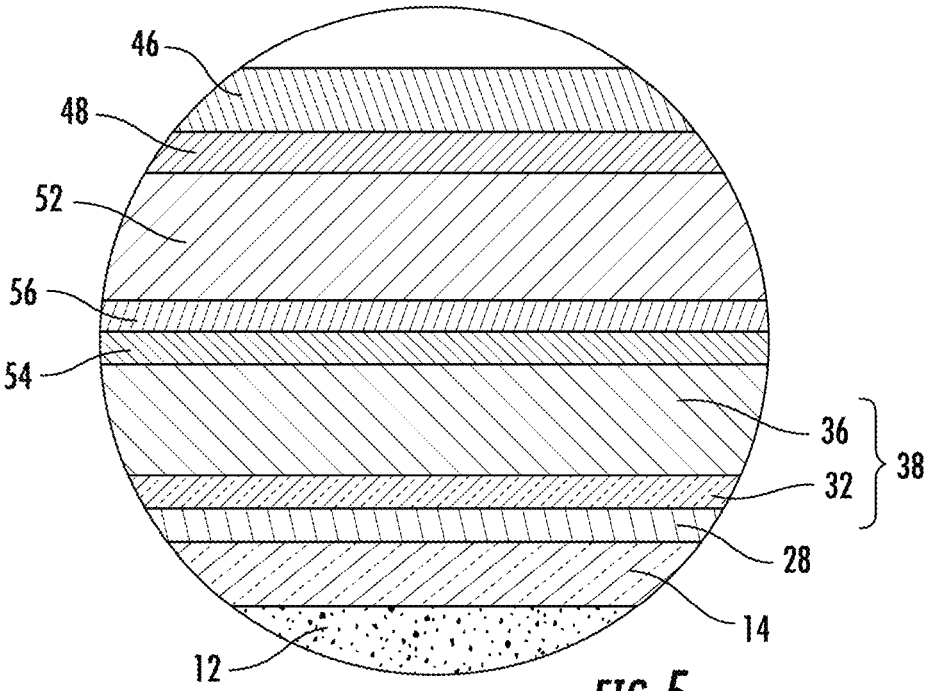
FIG. 5 shows an enlarged cross-sectional view of a portion of a resistor according to an embodiment of the invention showing the area designated as "FIG. 5" in FIG. 2.
Figure 6:
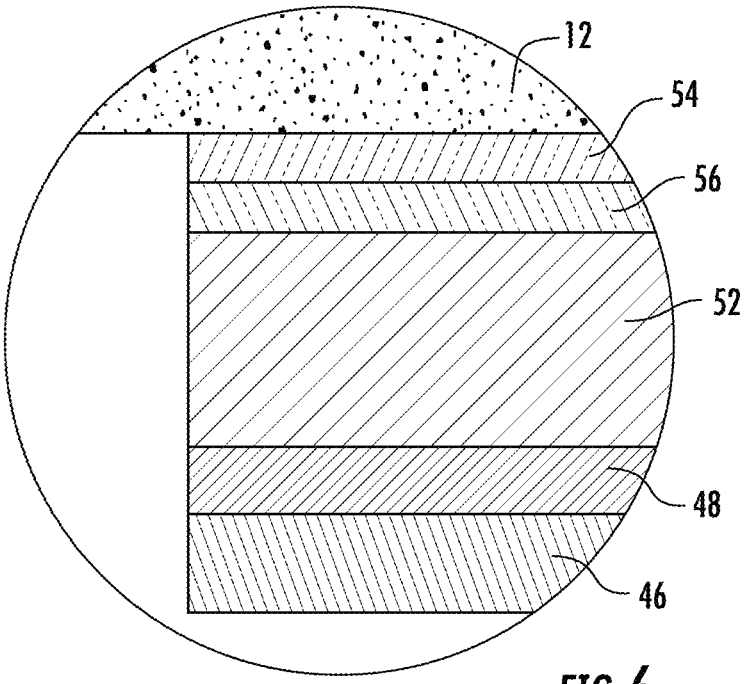
FIG. 6 shows an enlarged cross-sectional view of a portion of a resistor according to an embodiment of the invention showing the area designated as "FIG. 6" in FIG. 2.

A PVD copper alloy may also be applied in combination with an alloy adhesion layer, such as a nickel alloy, directly to the surface of the conductor pads 38, extending onto the surface of the substrate 12, around the side ends 204, 206 of the resistor and onto the bottom of the substrate 12, thereby replacing or as an alternative to the nickel alloy adhesion layer 54 and the nickel alloy conductor layer 56 shown in FIG. 5.

Figure 8A:
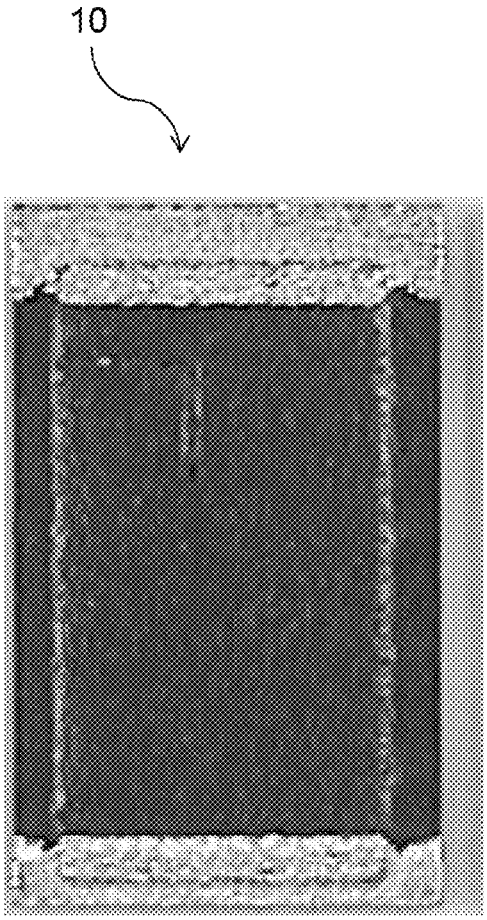
FIG. 8A shows a top surface of a resistor made according to the teachings of the present invention.
Figure 8B:
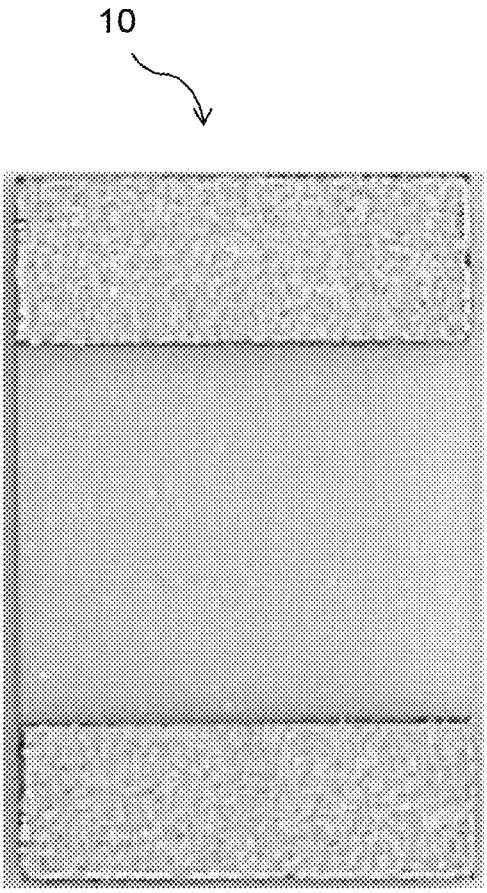
FIG. 8B shows a bottom surface of a resistor made according to the terms of the present invention.

FIG. 8A shows a top view of a resistor 10 made according to an embodiment of the present invention using thermal spraying techniques, and FIG. 8B shows a bottom view of the resistor 10. A finished thin film resistor according to the invention has an appearance similar to typical thin film chip resistors made without the benefit of the thermal spraying techniques described herein, but can be produced at a much lower cost and at resistance values well below those of typical thin film product.

A sample thin film resistor was created using a thermal spray technique according to the present invention, shown in FIGS. 16-19. FIGS. 16-19 show enlarged images of cross sections of an exemplary thin film resistor according to the teachings of the present invention at various magnifications. As shown in FIGS. 16-19, a thin film resistor 10 was formed with an aluminum oxide substrate 12. A PVD applied thin film nickel alloy bond layer 14 was applied to a portion of the top surface of the substrate 12. A nickel chromium alloy was thermally sprayed over a portion of the alloy bond layer 14 to form a thermally sprayed resistive element 20. A moisture passivation layer 40 was screen printed on a portion of the upper surface of the thermally sprayed resistive layer 18, and a mechanical protection layer 42 was screen printed over a portion of the moisture passivation layer 40 to form an overcoat 50.

To form the conductor pads 38, a PVD applied thin film titanium alloy adhesion layer 28 was applied at sides of the upper surface of the thermally sprayed resistive layer 18. A PVD applied thin film gold first conductor layer 32 was applied over the alloy adhesion layer 28. A gold second conductor layer 36 was plated over the first conductor layer 32.

To electrically connect the upper side and the lower side of the resistor, a nickel barrier layer 48 was applied by plating running from the conductor pads 38 along the sides of the substrate 12, and along a portion of the bottom of the substrate. A thin film nickel alloy conductor layer 56 was applied by PVD over the adhesion layer. A copper conductor layer 52 was applied by plating over the nickel alloy conductor layer 56. A nickel barrier layer 48 was applied by plating over the copper conductor layer 52. A hot dipped lead free solder layer 46 was applied over the nickel barrier layer 48.

In the examples shown in FIGS. 16-19, a nickel chromium alloy was used as the thermally sprayed material 16. In addition, low resistance value thin film resistors can also be made according to the present invention using other metal alloys such as MANGANIN® and EVANOHM®, or metal alloys including but not limited to those comprising copper, tantalum and titanium. The thermally sprayed material 16 may be a combination of alloys selected to achieve particular electrical properties, such as a particular temperature coefficient or resistance (TCR) profile (e.g., a net flat TCR profile) or resistivity.

It will be appreciated that the foregoing is presented by way of illustration only and not by way of any limitation. It is contemplated that various alternatives and modifications may be made to the described embodiments without departing from the spirit and scope of the invention. Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A thin film resistor comprising:
- a substrate;
- an alloy bond layer deposited on the substrate; and
- a thermally sprayed resistive element thermally sprayed directly on at least a portion of the alloy bond layer.

2. A method of forming a thin film resistor, comprising the steps of:
- providing a substrate having a first surface, side surfaces, and a second surface opposite the first surface;
- depositing an alloy bond layer directly over at least a portion of the first surface;
- thermally spraying a thermally sprayed resistive layer directly over at least a portion of the alloy bond layer, wherein the thermally sprayed resistive layer is applied at a rate of at least 10 micrometers per minute;
- forming conductor pads adjacent sides of the thermally sprayed resistive layer and in contact with at least a portion of the alloy bond layer; and
- electrically connecting the first surface and the second surface of the resistor.

3. The thin film resistor of claim 1, wherein the thermally sprayed resistive element comprises an alloy of copper, nickel, tantalum or titanium.

4. The thin film resistor of claim 1, wherein the alloy bond layer comprises an alloy of copper, nickel, tantalum or titanium.

5. The thin film resistor of claim 4, wherein the thermally sprayed resistive element is chemically bonded to the alloy bond layer.

6. The thin film resistor of claim 1, wherein the thermally sprayed resistive element is formed from particles of a thermally sprayed material demonstrating mechanical bonding, mechanical interlocking, diffusion bonding, or metallurgical bonding.

7. The thin film resistor of claim 1, wherein the thin film resistor has a resistance value of 10.0 Ohms or less.

8. The thin film resistor of claim 1, wherein the thin film resistor has a resistance value of 1.0 Ohms or less.

9. A method of making a thin film resistor, the method comprising depositing an alloy bond layer on a substrate and thermally spraying a thermally sprayed material using a thermal spraying process directly on at least a portion of the alloy bond layer to form a thermally sprayed resistive element.

10. The method of claim 2, wherein the step of forming conductor pads comprises the steps of:
- depositing adhesion layers adjacent sides of the thermally sprayed resistive layer and over portions of the alloy bond layer;
- depositing first conductor layers over the adhesion layers; and
- plating second conductor layers over the first conductor layers.

11. The method of claim 9, wherein the thermally sprayed material is applied at a deposition rate of at least 10 micrometers per minute.

12. The method of claim 9, wherein the thermally sprayed resistive element has a thickness of at least 1.0 micrometers.

13. The method of claim 9, wherein the thermally sprayed resistive element comprises an alloy of copper, nickel, tantalum or titanium.

14. The method of claim 13, wherein the alloy bond layer comprises an alloy of copper, nickel, tantalum or titanium.

15. The method of claim 14, wherein the thermally sprayed resistive element is chemically bonded to the alloy bond layer.

16. The method of claim 9, wherein the thermally sprayed material is thermally sprayed at a rate of at least 10 micrometers per minute.

17. The method of claim 9, wherein the thin film resistor has a resistance value of 10.0 Ohms or less.

18. The method of claim 9, wherein the thin film resistor has a resistance value of 1.0 Ohms or less.

19. A thin film resistor, comprising:
- a substrate having a first surface and an opposite second surface;
- an alloy bond layer deposited on at least a portion of the first surface of the substrate;
- a thermally sprayed resistive layer thermally sprayed directly on at least a portion of the alloy bond layer;
- conductor pads provided adjacent sides of the thermally sprayed resistive layer and in contact with at least a portion of the alloy bond layer;
- an electrical connection connecting the first surface to the second surface.

20. The thin film resistor of claim 19, wherein the conductor pads comprise first conductor layers and second conductor layers.

21. The thin film resistor of claim 20, further comprising adhesion layers beneath the first conductor layers.

22. The thin film resistor of claim 19, wherein the electrical connection comprises alloy adhesion layers extending from adjacent the conductor pads, along the sides of the substrate, and at least partially along portions of the second surface of the substrate.

23. The thin film resistor of claim 20, wherein the electrical connection further comprises third conductor layers applied over the adhesion layers.

24. The thin film resistor of claim 23, wherein the electrical connection further comprises fourth conductor layers applied over the third conductor layers.

25. The thin film resistor of claim 24, further comprising barrier layers applied over the fourth conductor layers.

26. The thin film resistor of claim 25, further comprising a solder finish provided over the barrier layers.

27. The method of claim 10, wherein the step of electrically connecting the first surface and the second surface comprises the steps of:

depositing adhesion layers adjacent the conductor pads, along portions of the first surface and sides of the substrate, and at least partially along portions of the second surface of the substrate;

depositing third conductor layers over the adhesion layers; and plating fourth conductor layers over the third conductor layers.

28. The method of claim 27, further comprising applying barrier layers over the fourth conductor layers; and, applying solder over the barrier layers.

29. The method of claim 2, further comprising providing an overcoat over exposed parts of the thermally sprayed resistive layer.

30. The method of claim 29, wherein the step of providing an overcoat comprises the steps of:

providing a moisture passivation layer over at least a portion of the thermally sprayed resistive layer; and providing a mechanical protection layer over at least a portion of the moisture passivation layer.

* * * * *